US008088714B2

(12) United States Patent
Singer et al.

(10) Patent No.: US 8,088,714 B2
(45) Date of Patent: Jan. 3, 2012

(54) METHOD FOR PRODUCTION OF HOLLOW BODIES FOR RESONATORS

(75) Inventors: Xenia Singer, Hamburg (DE); Waldemar Singer, Hamburg (DE); Johannes Schwellenbach, Bergisch Gladbach (DE); Michael Pekeler, Bergisch Gladbach (DE)

(73) Assignee: Deutsches Elektronen-Synchrotron Desy (DE)

( * ) Notice: Subject to any disclaimer, the term of this patent is extended or adjusted under 35 U.S.C. 154(b) by 764 days.

(21) Appl. No.: 12/095,901

(22) PCT Filed: Nov. 29, 2006

(86) PCT No.: PCT/EP2006/011464

§ 371 (c)(1),
(2), (4) Date: Sep. 30, 2008

(87) PCT Pub. No.: WO2007/062829

PCT Pub. Date: Jun. 7, 2007

(65) Prior Publication Data

US 2009/0215631 A1 Aug. 27, 2009

(30) Foreign Application Priority Data

Dec. 2, 2005 (DE) ..... 10 2005 058 398
May 5, 2006 (DE) ..... 10 2006 021 111

(51) Int. Cl.
*H01P 11/00* (2006.01)
*H05H 7/20* (2006.01)

(52) U.S. Cl. ..... 505/300; 505/210; 333/227

(58) Field of Classification Search ..... 505/210, 505/300, 921, 951; 148/96; 333/227, 99 S; 315/505

See application file for complete search history.

(56) References Cited

U.S. PATENT DOCUMENTS 4,857,360 A * 8/1989 Halbritter et al. ..... 427/62
5,347,242 A * 9/1994 Shimano et al. ..... 333/99 S (Continued)

FOREIGN PATENT DOCUMENTS

DE 3722745 A1 1/1989

(Continued)

OTHER PUBLICATIONS

Dzenus M et al., "Production of Superconducting Niobium Cavities for CEBAF", Proceedings of the Particle Accelerator Conference, San Francisco, CA, pp. 2390-2392 (May 6-9, 1991), Document No. XP010049494, ISBN: 0-7803-0135-8 (Published 1991, USA).

(Continued)

*Primary Examiner* — Mark Kopec
(74) *Attorney, Agent, or Firm* — Hovey Williams LLP

(57) ABSTRACT

A method for production of hollow bodies, in particular for radio-frequency resonators is shown and described. The object to provide a hollow bodies and a resonator, respectively, having improved electrical properties is achieved by a method comprising the following steps: Providing a substrate having a monocrystalline region, defining a cut area through the substrate, fitting markings on both sides of the cut area, producing two wafers by cutting along the cut area, wherein the wafers are completely removed from the monocrystalline region, forming the wafers into half-cells, wherein the half-cells have a joining area, joining together the half-cells to form a hollow body, wherein the joining areas bear on one another, and wherein the markings on the half-cells are oriented with respect to one another on both sides of the joining area as on both sides of the cut areas.

23 Claims, 6 Drawing Sheets

U.S. PATENT DOCUMENTS

Figure 1:
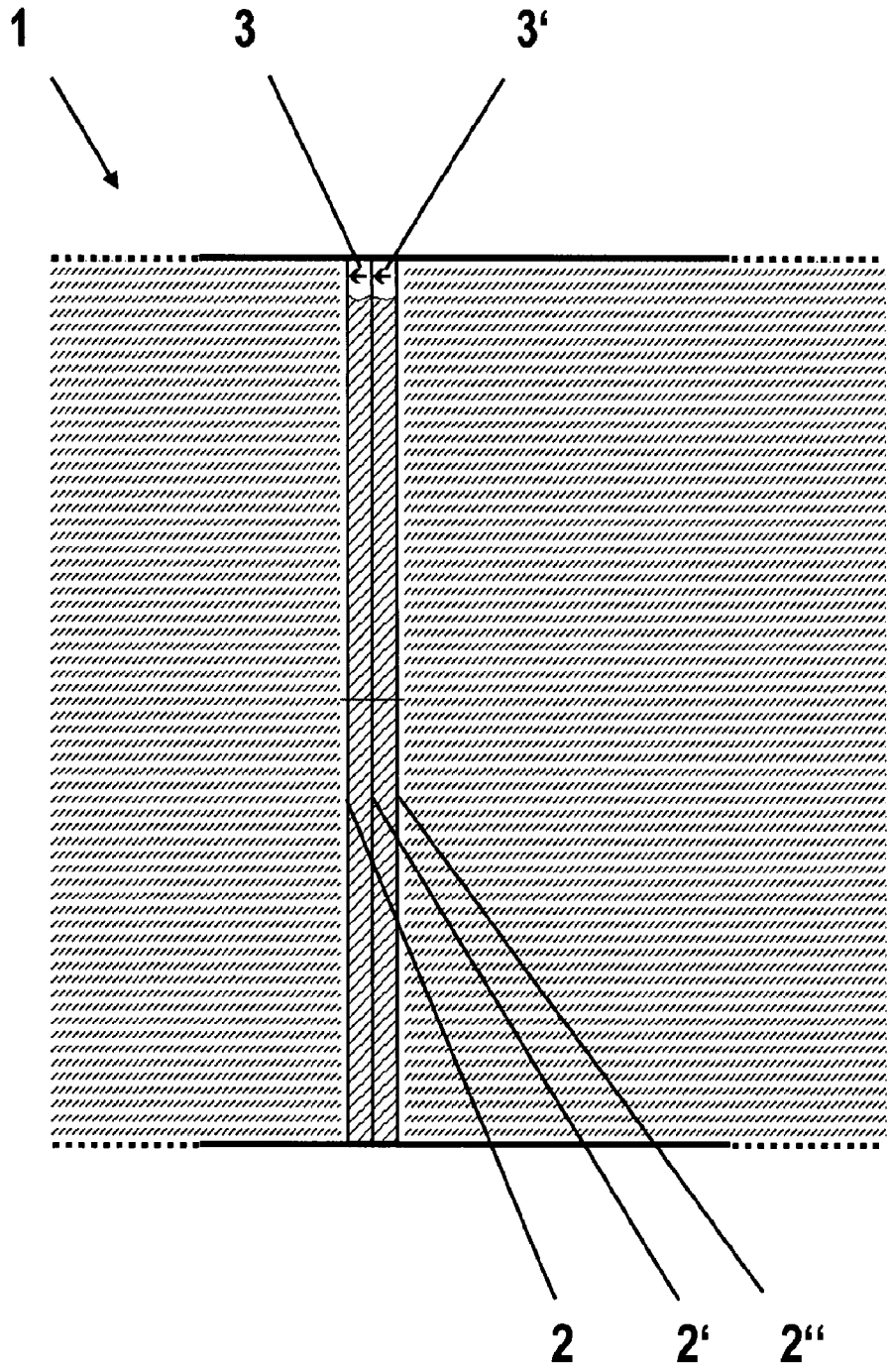

| | | | | |
|---|---|---|---|---|
| 5,500,995 | A | 3/1996 | Palmieri et al. | |
| 7,746,192 | B2 * | 6/2010 | McIntyre | 333/99 S |

FOREIGN PATENT DOCUMENTS

| | | | |
|---|---|---|---|
| EP | 0483964 | A2 | 5/1992 |
| JP | 03135000 | A | 6/1991 |
| JP | 03147299 | A | 6/1991 |
| JP | 05266996 | A | 10/1993 |

OTHER PUBLICATIONS

Kneisel P et al., "Preliminary Results from Single Crystal and Very Large Crystal Niobium Cavities", 2005 IEEE Particle Accelerator Conference (PAC), Knoxville, TN, pp. 3676-3678 (May 16-20, 2005), Document No. XP010892055, ISBN: 0-7803-8859-3 (Published 2005, USA).

* cited by examiner

METHOD FOR PRODUCTION OF HOLLOW BODIES FOR RESONATORS

CROSS-REFERENCE TO RELATED APPLICATIONS

This is a National Phase Application pursuant to 37 C.F.R. §371 of International Application No. PCT/EP2006/011464, filed Nov. 29, 2006, claiming priority from German Application No. DE 10 2005 058 398.9, filed Dec. 2, 2005 and German Application No. DE 10 2006 021 111.1, filed May 5, 2006, the entire disclosures of all of which are hereby incorporated by reference herein.

BACKGROUND OF THE INVENTION

1. Field of the Invention

The present invention relates to a method for production of hollow bodies, in particular for radio-frequency resonators.

Radio-frequency resonators comprising a multiplicity of hollow bodies are used in particle accelerators, in particular, which use electric fields to accelerate charged particles to high energies.

In such radio-frequency resonators, also called cavity resonators, an electromagnetic wave is excited which accelerates charged particles along the resonator axis. The particle accelerated in this way experiences a maximum possible energy gain if it travels through the resonator with regard to the phase and the radio-frequency field in such a way that it is situated in the centre of a cavity cell precisely when the electric field strength reaches its maximum there. In this case, the cavity cell length and the frequency are adapted in such a way that the particles experience the same energy gain in each cell. In this case, superconducting resonators for the provision of high field strengths have the advantage that far less energy has to be expended on account of the very low radio-frequency resistance.

2. Discussion of the Prior Art

For a long time one method for resonator production involved the so-called half hollow bodies produced from a polycrystalline niobium metal sheet by means of deep-drawing being connected to one another by electron beam welding. Moreover, DE 37 22 745 A1 discloses a method in which half-cells composed of coated metal sheets are connected. Furthermore, said document discloses a resonator produced according to said method, and in particular a superconducting radio-frequency resonator composed of niobium coated with copper.

Furthermore, U.S. Pat. No. 5,500,995 discloses producing multicell cavity resonators without weld seams by the desired material being applied to a shaping, removable substance, which serves as a support, by means of spinning technology and being correspondingly deformed and the shaping substance subsequently being removed again.

The metal sheets used in the two methods known from the prior art are coated with a suitable superconducting material or completely consist of the latter. In this case, a preferred material is superconducting niobium since it can be machined very well, on the one hand, and has a high critical temperature $T_c \cong 9.2$ K and a high critical magnetic field $H_c \cong 200$ mT (temperature and magnetic field above which the superconductivity collapses), on the other hand.

After forming, the material is subjected to further treatment in a conventional manner in order to obtain a surface having minimum roughness since the surface is generally roughened during the forming of a polycrystalline material. Moreover, the internal surface is intended to be free of contaminants and impurity particles. This is because surface defects are responsible, inter alia, for the superconductivity collapsing since the currents circulating in the surface layer of the superconductor, which prevent an external magnetic field from penetrating internally (Meißner-Ochsenfeld effect), are interrupted. Finally, a rough surface results in very high field strengths occurring locally here, which is likewise undesirable.

A customary surface treatment method is a chemical (pickling) method with an acid mixture, referred to as BCP (Buffered Chemical Polishing), using HF (48%), $HNO_3$ (65%) and $H_3PO_4$ (85%) in a ratio of 1:1:2. However, since the grain boundaries of polycrystalline material are attacked to a greater extent than the material of the grains themselves, a relatively rough surface is still present after this treatment. Moreover, this method is comparatively time-consuming. A method that yields better results is electropolishing ("EP"), wherein HF and $H_2SO_4$ are used in a ratio of 1:9 and an electric field is applied. Electropolishing achieves a very smooth surface even in the case of polycrystalline material, such that a roughness of 250 nm can be achieved in the case of hollow bodies composed of polycrystalline niobium by means of electropolishing.

Since superconductivity is disturbed at the grain boundaries of a polycrystalline material, recently experiments were carried out with regard to the usability of niobium ingots (residual resistivity ratio RRR>250) for production of half-cells with a positive result (P. Kneisel, G. R. Myeni, G. Ciovati, J. Sekutowicz and T. Carneiro; Preliminary Results From Single Crystals and Very Large Crystal Niobium Cavities; Proceedings of 2005 Particle Accelerator Conference, Knoxville, Tenn., USA). In this case, in order to produce a small cavity resonator, two wafers were cut from a coarsely crystalline niobium ingot by means of a wire erosion machine and then brought to the desired form by deep-drawing, without any alteration in the crystalline properties. In that case, too, defect locations occurred, however, at the locations at which the formed crystalline wafers were joined together to form a hollow body.

In addition to the as far as possible defect-free crystal structure in the cavity resonators, it is very important for the quality of superconducting cavity resonators that no superconductivity losses occur at the connection locations as well.

A further factor which has a disturbing effect on superconductivity is hydrogen incorporated in the superconducting material. This problem is conventionally solved by carrying out a thermal treatment.

SUMMARY

Proceeding from the prior art, therefore, the object of the present invention is to provide a method in which the hollow bodies produced or the entire resonator have (has) improved electrical properties.

This object is achieved by means of a method comprising the following steps:

- providing a substrate having a monocrystalline region,
- defining a cut area through the substrate,
- fitting markings on both sides of the cut area,
- producing two wafers by cutting along the cut area, wherein the wafers are completely removed from the monocrystalline region,
- forming the wafers into half-cells, wherein the half-cells have a joining area,
- joining together the half-cells to form a hollow body, wherein the joining areas bear on one another, and wherein the markings on the half-cells are oriented with respect to one another on both sides of the joining area as on both sides of the cut areas.

In the method according to the invention, a first step involves providing a substrate having a monocrystalline region, which is composed of superconducting material in a preferred embodiment. In this case, a preferred material is superconducting niobium since it can be shaped very well and, moreover, has a high critical temperature $T_c \cong 9.2$ K and a high critical magnetic field $H_c \cong 200$ mT. In this context, "superconducting" material is understood to mean a material which, under suitable ambient conditions and below a critical temperature, has superconducting properties, that is to say abruptly loses its electrical resistance and displaces subcritical magnetic fields from inside it. Furthermore, the monocrystalline region is preferably shaped in cylindrical fashion so as to be easily accessible.

A second step involves defining at least one cut area through the substrate, and a subsequent third step involves fitting markings on both sides of the cut area. Preferably, said markings are stamped or embossed since superconducting materials are metals which have a hard surface. The markings are configured in such a way that adjacent regions in the substrate can also be identified again after separation and their original orientation with respect to one another can be re-established. In this case, the markings are preferably fitted on the outer area or on the circumferential area of the wafers.

After the markings have been fitted, two wafers are produced by cutting along the cut area, wherein the wafers are furthermore cut from the substrate in such a way that they only comprise monocrystalline material. In a preferred embodiment, the wafers are approximately 5 mm thick and have a diameter or an extent in the plane of the cut area of 200 mm.

A subsequent step involves forming the wafers into half-cells, wherein the half-cells have a joining area. These joining areas serve to be able to join together two half-cells. In a preferred embodiment, the half-cells furthermore have a termination area running parallel to the joining area, which termination area enables the half-cell also to be connected to a further half-cell on the opposite side to the joining area.

The forming is preferably effected by pressing, deep-drawing and, where appropriate, rolling, which are known metal processing techniques. In this regard, the area of the wafer may have been enlarged beforehand, which is likewise possible with the aid of the techniques already mentioned.

In the case of forming, one preferred embodiment comprises creating a hollow truncated cone having two parallel open end areas. Furthermore, the half-cells are preferably shaped in rotationally symmetrical fashion in order that half-cells can be connected to one another as simply as possible.

As an alternative, forming can also be effected in such a way as to comprise creating a hollow cone by deep-drawing or pressing against a mould, wherein, in a further preferred embodiment, the largest diameter of the hollow cone is greater than or equal to the external diameter of the half-cell. This makes it possible for the cone subsequently to be brought to the desired form and size of the half-cell with a minimum number of machining steps, without the monocrystalline structure being lost.

In the course of the forming step it is possible for a wafer, before a hollow cone or a truncated cone is shaped, for example, to be formed by means of rolling or pressing into a wafer which has an enlarged diameter with respect to the original wafer. This makes it possible for monocrystalline half-cells of the desired size also to be shaped from wafers which originate from an ingot having a small diameter.

A further step of the method involves joining together the half-cells to form hollow bodies, wherein the joining areas bear on one another and the markings are oriented with respect to one another on both sides of the joining area as on both sides of the cut areas. This means that half-cells produced from the wafers bear on one another along the joining areas as was the case in the substrate before the cutting of the cut areas. The monocrystalline orientation is thereby maintained in both wafers that are formed into hollow bodies.

Owing to the sensitivity of high-purity niobium with respect to contaminants of any type, the areas to be joined can be cleaned shortly before joining, which is preferably done by means of a chemical pickling treatment (by means of BCP).

Preferably, the joining is carried out by electron beam welding in a high vacuum ($<10^{-4}$ mbar), and, if appropriate, with a defined residual gas composition. This technique has a high power density, such that it is possible to weld components having a smooth seam that is 5 to 7 mm wide since a locally limited energy input occurs.

In a preferred embodiment, the joining and/or termination areas are subjected to chemical treatment. This is preferably carried out by means of a pickling treatment, in particular by means of BCP (1:1:2). This prevents impurity material from being introduced into the material in the region of the weld seam.

The hollow body is subsequently subjected to thermal treatment. By this means, defects that still exist and the joining locations are annealed, the hydrogen contained in the material is driven out and the RRR value, which describes the purity of the niobium preferably used, is thus increased.

A preferred embodiment of the thermal treatment comprises, in the case of a hollow body composed of niobium, a first heating step of 400° C. to 500° C. for 2 to 6 hours and a second heating step of 750° C. to 850° C., preferably 750° C. to 800° C. The aim of the first heating step is to relieve the stresses produced by the forming processes and to eliminate newly produced crystallization seeds. The second heating step serves for removing hydrogen that is present from the material and for relaxation of the entire hollow body. In this case, the single crystal is maintained since crystallization seeds have been eliminated beforehand, such that no grain growth can occur as a result of the thermal treatment.

The thermal treatment is dependent on the degree of deformation $\epsilon$ of the material, which is approximately 40% in the preferred exemplary embodiment with niobium. In this context, the degree of deformation $\epsilon$ of a material is understood to mean the percentage proportion of forming. The degree of deformation $\epsilon$ is calculated as $$\varepsilon = \frac{t_0 - t}{t_0} \cdot 100\%$$

where $t_0$ is the thickness of the undeformed wafer and t is the thickness of the deformed wafer.

The method according to the invention makes it possible to produce a monocrystalline resonator comprising monocrystalline hollow bodies or half-cells. Such monocrystalline resonators have outstanding electrical properties. In particular, circulating currents are also present in the monocrystalline surface layer of the superconductor (niobium) and prevent an external magnetic field from penetrating internally, whereby superconductivity is not disturbed. In addition, in the case of monocrystalline material, significantly reduced roughnesses in particular of the internal surface can be achieved, which are 25 nm in the case of a concluding BCP treatment. This means an improvement by a factor of 10 relative to comparable polycrystalline material after a more complicated aftertreatment.

The above object is furthermore achieved by means of a method comprising the following steps:

- producing a multiplicity of hollow bodies as claimed in any of claims 2 to 18,
- joining the hollow bodies along the termination areas, wherein half-cells of originally adjacent wafers in the substrate are connected, and wherein the markings adjacent to the termination areas are assigned to one another as on both sides of the cut area between the wafers.

In the method according to the invention, firstly a multiplicity of hollow bodies are produced and these are subsequently joined together along the termination areas. In this case, the hollow bodies are always connected to hollow bodies produced from adjacent wafers of the raw material, wherein the markings adjacent to the termination areas are assigned to one another as on both sides of the cut area. This ensures that the monocrystalline structure is also maintained between adjacent hollow bodies. In a preferred embodiment, the surface of the resonator is treated. This is preferably done by means of a chemical method by means of BCP (1:1:2). In principle, the chemical method can be carried out before or after joining. It is very important to prepare an internal surface of the resonator hollow body in such a way that it is free of contaminants and impurity particles, in order to generate high electric fields without losses. This is done after or else without a previously performed thermal treatment by means of a chemical or electrical standard method.

BRIEF DESCRIPTION OF THE DRAWING FIGURES

Figure 2:
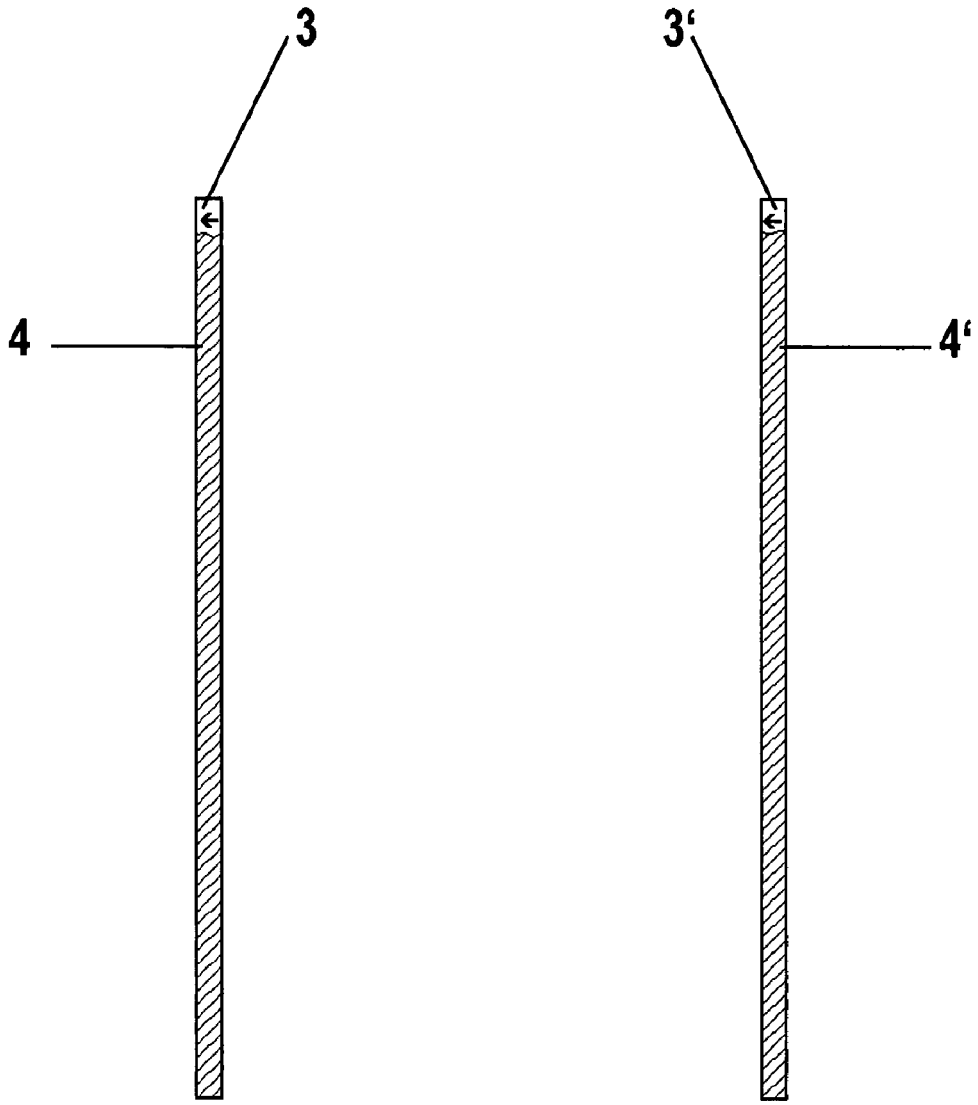
Figure 3:
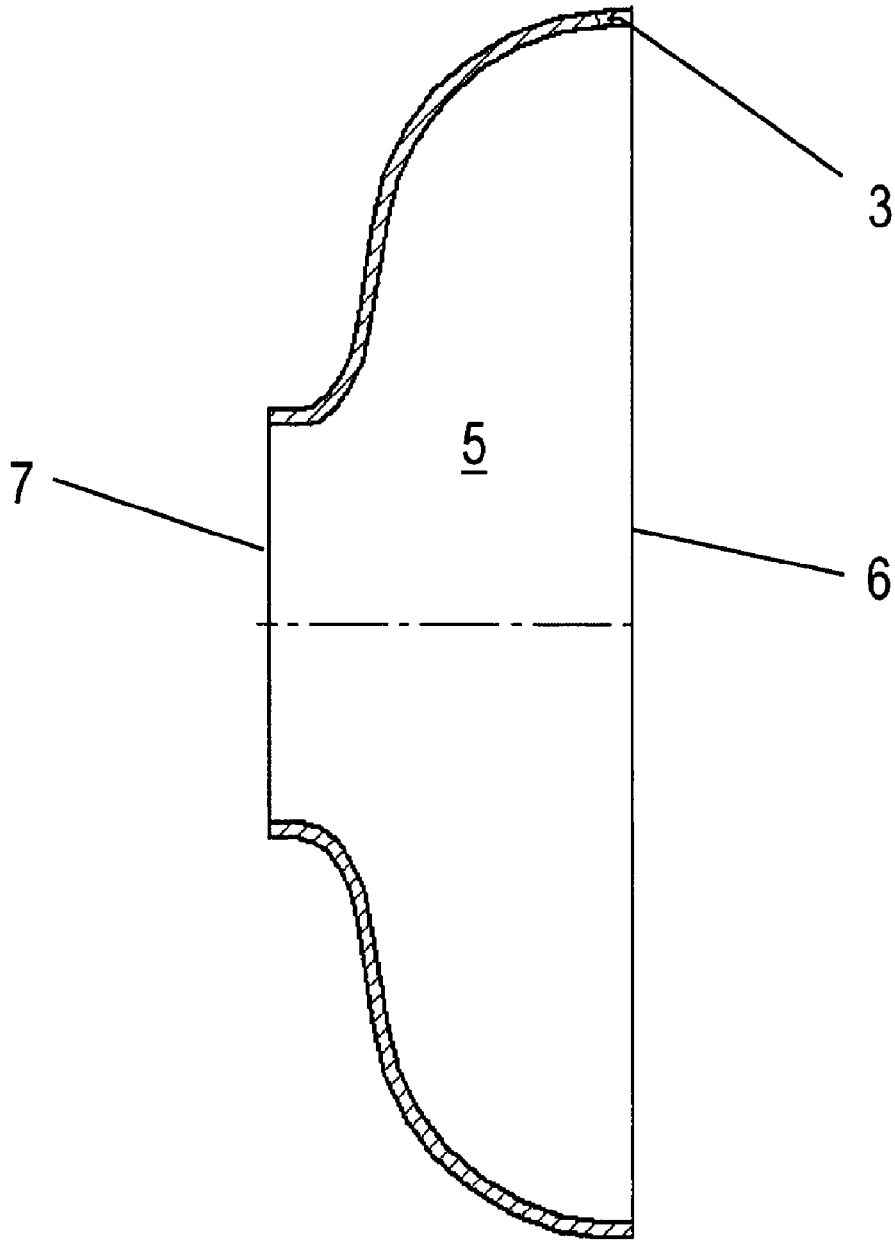
Figure 4:
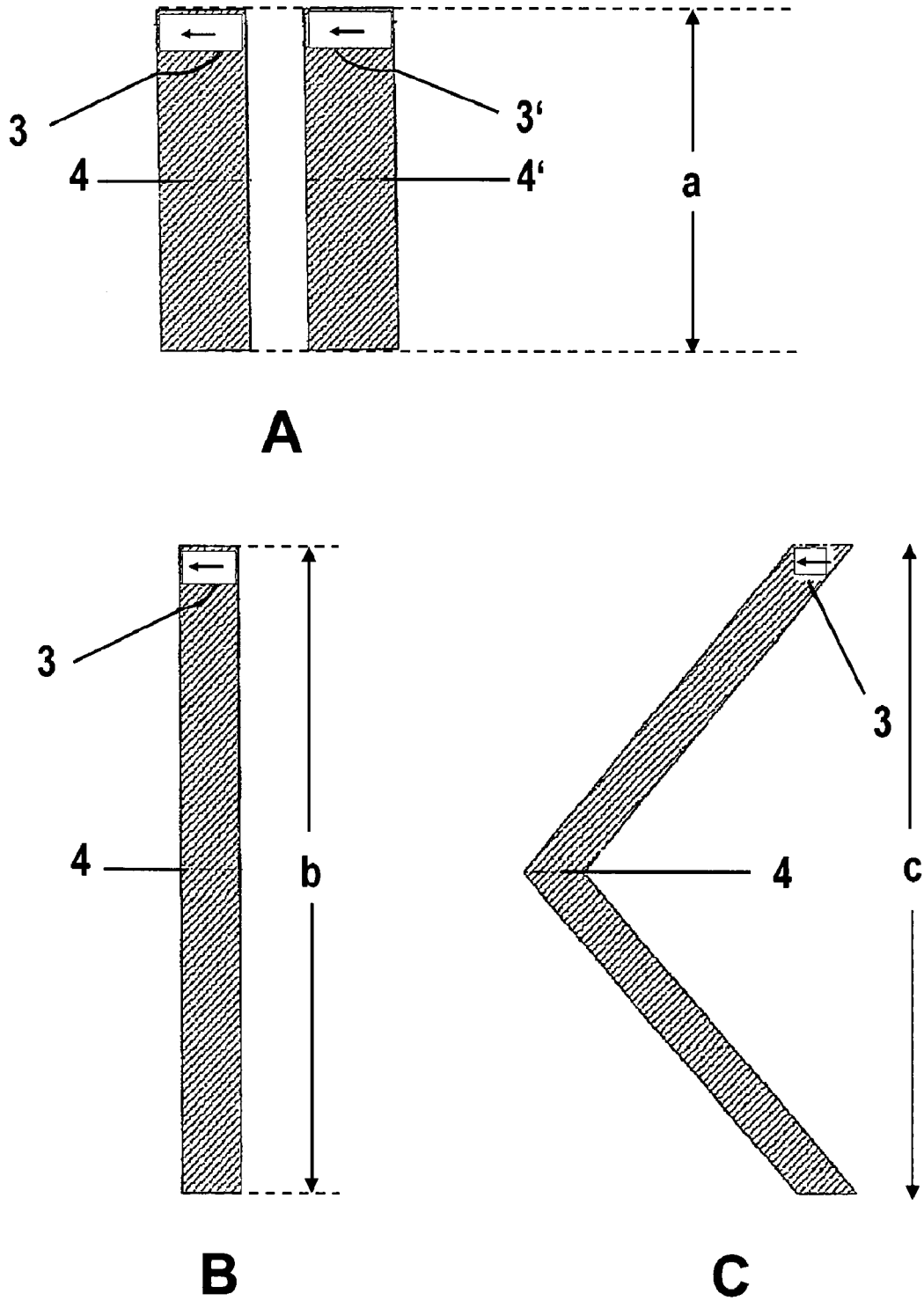
Figure 5:
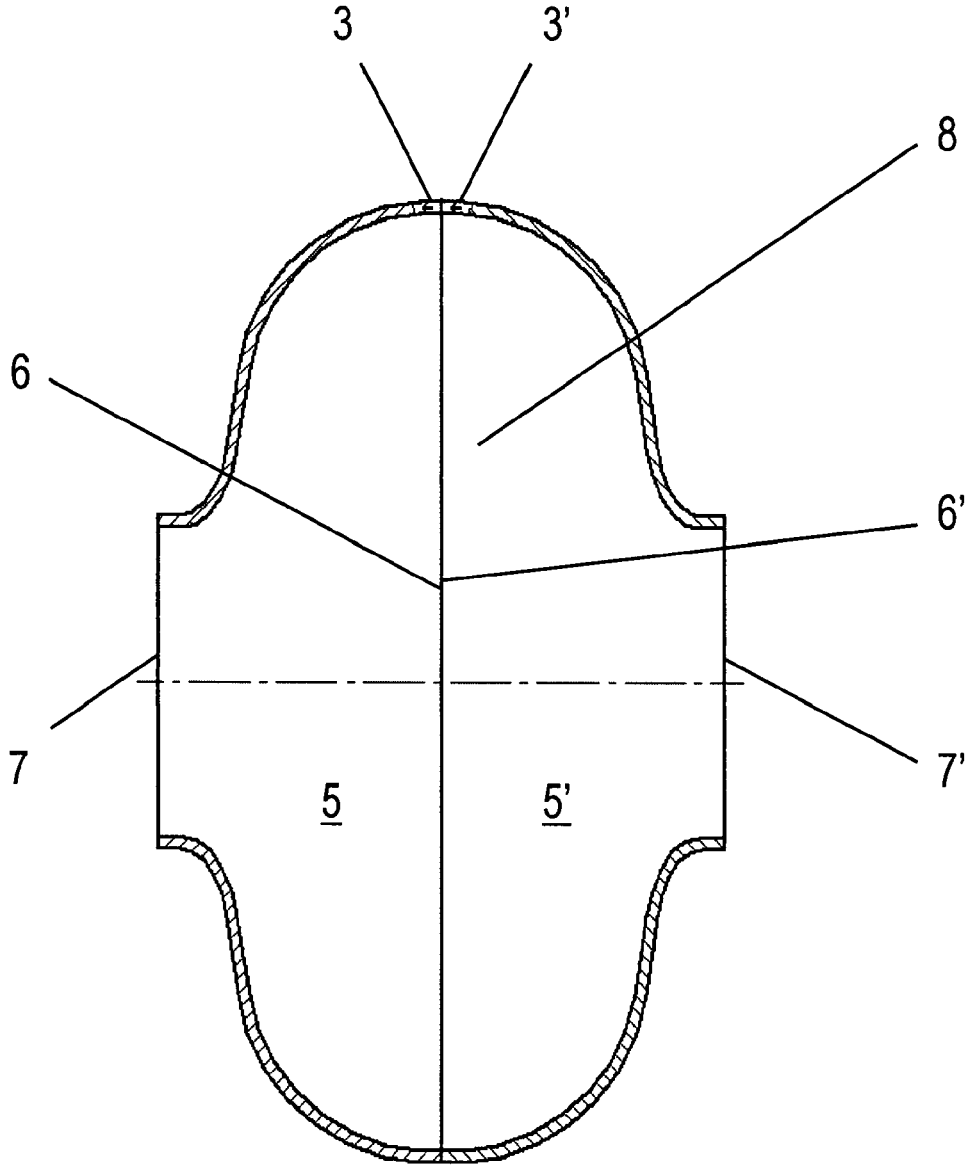
Figure 6:
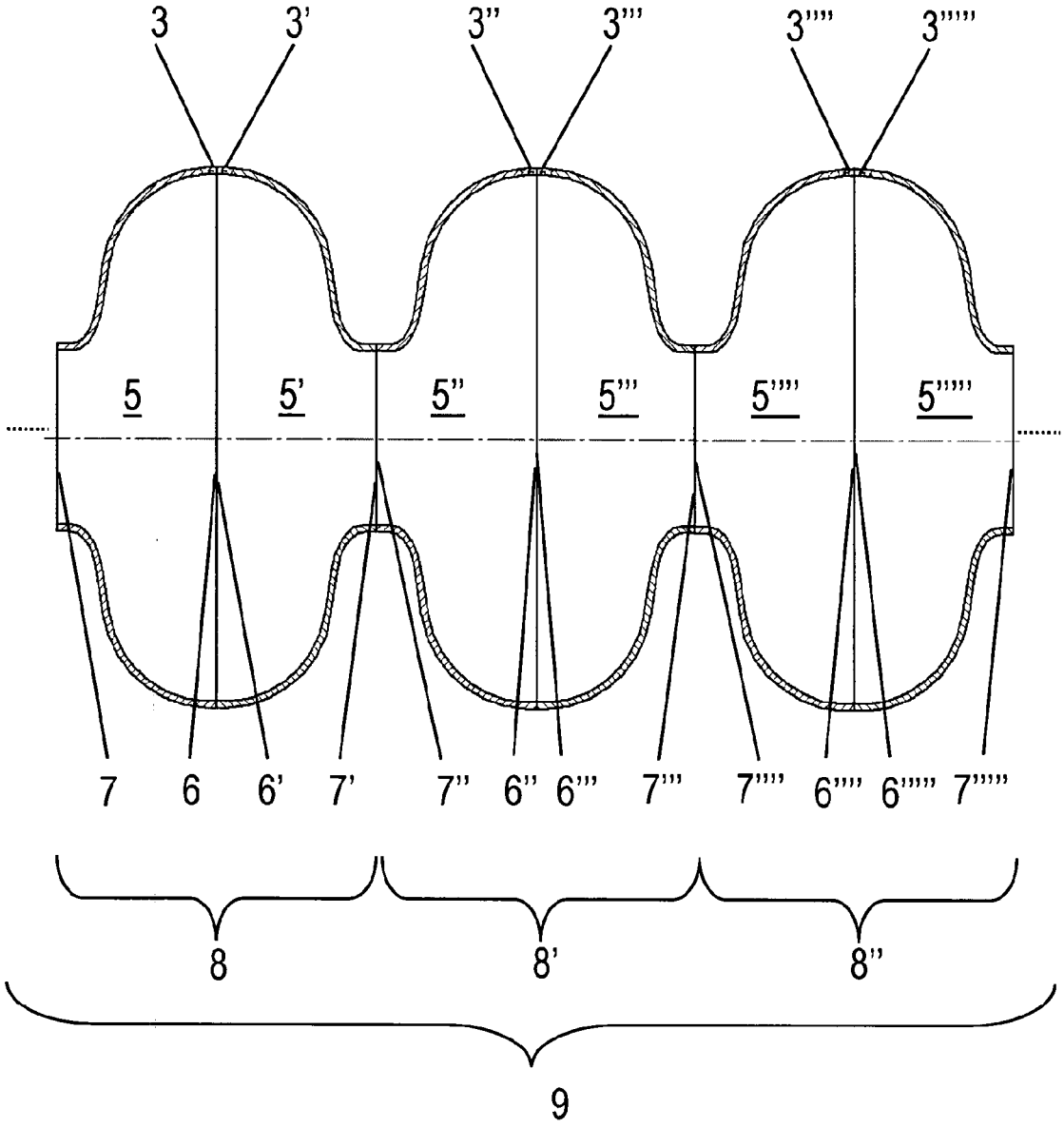

The present invention is explained below with reference to a drawing showing only one preferred embodiment. In the drawing:

FIG. 1 shows a cross-sectional view of a substrate with a monocrystalline region and defined cut areas, FIG. 2 shows a cross-sectional view of wafers which have been produced by cutting along the cut area, FIG. 3 shows a cross-sectional view of a half-cell produced from a wafer by forming, FIG. 4A shows a cross-sectional view of wafers which have been produced by cutting along the cut area, FIG. 4B shows a cross-sectional view of a wafer which has been brought to a suitable size by forming, FIG. 4C shows a cross-sectional view of a cone produced from a wafer by forming, FIG. 5 shows a cross-sectional view of a hollow body composed of two half-cells joined together, and FIG. 6 shows a cross-sectional view of a resonator joined together from a multiplicity of hollow bodies.

The figures illustrate the steps of a preferred embodiment of the method according to the invention.

DETAILED DESCRIPTION OF THE PREFERRED EMBODIMENTS

FIG. 1 shows a substrate 1 having a monocrystalline region (hatched), which is provided for production of hollow bodies for resonators. The monocrystalline region preferably has a cylindrical form, and the material of the substrate is preferably composed of niobium since it can be machined well and has a high critical temperature $T_c \cong 9.2$ K and a high critical magnetic field $H_c \cong 200$ mT. Three cut areas 2, 2', 2" lying alongside one another and running through the substrate 1 are subsequently defined. On both sides of the cut area 2', markings 3 and 3' are fitted on the surface of the substrate 1, which is preferably realized by stamping or embossing. The markings 3, 3' are configured in such a way that they are still visible after forming. One of the cut areas 2, 2', 2" can also form an end of the substrate 1, such that only two of the cut areas have to be defined.

Wafers 4 and 4' are thereupon produced by cutting along the defined cut areas 2, 2' and 2" (see FIG. 2), wherein the wafers 4, 4' are completely removed from the monocrystalline region. This last means that the wafers 4, 4' only comprise monocrystalline material and polycrystalline or amorphous regions possibly present are separated up. The markings 3, 3' are preferably stamped or embossed since the material is preferably a metal having a hard surface. The markings 3, 3' are configured in such a way that adjacent regions in the substrate 1 can also be identified again after separation and their original orientation with respect to one another can be re-established.

In this preferred embodiment, both wafers 4 and 4' are approximately 5 mm thick and, since they preferably originate from a cylindrical single crystal, have a diameter of 200 mm. In the case of a non-cylindrical monocrystalline region, the wafers 4 and 4' have an extent in the plane of the cut areas 2, 2', 2" of 200 mm.

FIG. 3 illustrates a first possibility for the subsequent step of forming the wafer 4 into a half-cell 5. The forming of the wafer 4 is preferably effected by pressing, deep-drawing and, if appropriate, rolling, wherein the half-cell 5 shown in cross section in FIG. 3 and a half-cell 5' shown in cross section in FIG. 5 are correspondingly produced. A forming intermediate step, in which the area of the wafer is firstly enlarged, and/or the creation of a hollow truncated cone with two parallel open end areas is also possible. Preferably, the half-cells 5, 5' are rotationally symmetrical. The half-cell 5 furthermore has a joining area 6 and a termination area 7. In this case, the joining area 6 and the termination area 7 preferably run parallel to one another. The marking 3 is fitted on the wafer 4 such that it is still visible after the forming of a wafer 4 into a half-cell 5.

FIG. 4 illustrates a second possibility for the forming of the wafers 4, 4'. Here the forming comprises creating a hollow cone by deep-drawing or pressing, wherein the pressing is effected against a negative mould. In this case, it is possible for the wafers 4, 4' which initially have a diameter a, before the forming into a cone or a truncated cone, for example, firstly to be formed by means of rolling or pressing into wafers 4 having a diameter b, which is greater than a. This makes it possible for half-cells 5, 5' of the desired size also to be shaped from wafers 4, 4' originating from an ingot having a small diameter. After forming, the largest diameter c of the hollow cone is greater than or equal to the external diameter of the half-cell 5. This makes it possible for the hollow cone to be brought to the desired form and size of the later half-cell 5 with a minimum number of machining steps, without the monocrystalline properties of the material being lost.

FIG. 5 shows a cross-sectional view of a hollow body 8 which has been joined together from two half-cells 5 and 5' with markings 3 and 3' along the two joining areas 6 and 6', which is preferably done by electron beam welding in a high vacuum ($<10^{-4}$ mbar) and furthermore preferably with a defined residual gas composition. Using this technique, the half-cells 5 and 5' can be welded with a smooth seam that is 5 to 7 mm wide, wherein only a locally limited energy input occurs. Moreover, this technique ensures that the weld seam is absolutely tight.

In this case, the joining areas 6 and 6' of two half-cells 5 and 5' have been joined together in such a way that the half-cells 5 and 5' composed of wafers 4 and 4' originally adjacent in the substrate 1 are arranged alongside one another, wherein the markings 3 and 3' adjacent to the joining areas 6 and 6' are arranged with respect to one another as was the case on both sides of the cut area 2 between the wafers 4 and 4'. The hollow body 8 comprising the combined half-cells 5 and 5' has two termination areas 7 and 7' that are essentially parallel to one another. The hollow body 8 produced from the half-cells 5, 5' is composed of monocrystalline material over the entire volume, also in the region of the earlier joining areas 6, 6', such that it has good electrical properties and circulating currents flow in the surface layer of the superconductor (niobium) and prevent an external magnetic field from penetrating internally, whereby the superconductivity is disturbed.

Preferably, the joining areas 6 and 6' and/or termination areas 7 and 7' are cleaned before joining. In this case, said areas are firstly rinsed and treated in an ultrasonic bath, then preferably pickled by means of a chemical method by means of BCP (1:1:2) in order to remove contaminations in this region, are once again rinsed with high-purity water and are finally dried in the clean room.

Afterward, in a preferred embodiment of the method, a special thermal treatment of the hollow body 8 can be effected, comprising heating over a period of two to six hours at 400° C. to 500° C. and then heating over a period of one to three hours at 750° C. to 850° C., preferably 750° C. to 800° C. Defects still present are thereby annealed. The aim of the first heating step is to relieve the stresses produced by the forming processes and to eliminate newly produced crystallization seeds. The second heating step serves for removing hydrogen that is present from the material and for relaxation of the entire hollow body.

The monocrystalline hollow bodies 8 produced in this way have outstanding electrical properties, wherein circulating currents are present in the monocrystalline surface layer of the superconductor (niobium) and prevent an external magnetic field from penetrating internally, whereby superconductivity is not disturbed. Moreover, by means of the monocrystalline material, significantly reduced roughnesses in particular of the internal surface can be achieved, which are 25 nm in the case of a concluding BCP treatment.

FIG. 6 shows a multiplicity of hollow bodies 8, 8', 8" which have been produced in accordance with the method described above and joined together analogously to the joining of two half-cells 5 and 5' to form a hollow body 8 at their termination areas 7', 7", 7''', 7'''', preferably likewise by electron beam welding. This means that the markings 3, 3', 3", 3''', 3'''', 3''''' adjacent to the termination areas 7, 7', 7", 7''', 7'''', 7''''' are arranged with respect to one another as on both sides of the cut areas 2 and 2' between the wafers 4, 4' from which the corresponding half-cells were produced. The resonator 9 produced by joining together a multiplicity of hollow bodies 8, 8', 8" can be polished, preferably by means of a chemical method by means of BCP (1:1:2).

For the sake of completeness, it should be mentioned at this juncture that it is also possible, of course, to join together two half-cells 5' and 5" at their termination areas 7' and 7" in such a way (see FIG. 6) that the adjacent markings 3' and 3" of the half-cells 5' and 5" have an orientation such as was the case on both sides of the cut area between the corresponding wafers. It is therefore conceivable that, as an alternative, firstly dumbbell-shaped hollow bodies are produced, which are then joined together to form the resonator 9.

A monocrystalline resonator 9 having improved electrical properties can be produced in this way. Said properties result in a considerable improvement in the quality of the superconductivity under suitable ambient conditions, such as e.g. a suitable temperature. Furthermore, the advantage when using a monocrystalline resonator 9 is that a much better surface quality (smoothness) can already be achieved by the simple chemical pickling method, even in comparison with electropolishing.

This means that it is possible, by means of a monocrystalline resonator 9, to attain high acceleration field strengths, on the one hand, and also to simplify the preparation, on the other hand.

The invention claimed is:

1. A method for production of hollow bodies for resonators, said method comprising the steps:

providing a substrate including a monocrystalline region;

defining a cut area through the substrate;

fitting markings on both sides of the cut area;

producing two wafers by cutting along the cut area, wherein the wafers are completely removed from the monocrystalline region;

forming the wafers into half-cells, wherein the half-cells each include a joining area; and joining together the half-cells to form a hollow body, wherein the joining areas bear on one another, and wherein the markings on the half-cells are oriented with respect to one another on both sides of the joining area in like orientation as on both sides of the cut areas.

2. The method as claimed in claim 1, said half-cells including a termination area running parallel to the joining areas.

3. A method for producing a resonator, said method comprising the steps:

producing a multiplicity of hollow bodies as claimed in claim 2; and joining the hollow bodies along the termination areas, wherein half-cells of originally adjacent wafers in the substrate are connected, and wherein the markings adjacent to the termination areas are assigned to one another as on both sides of the cut area between the wafers.

4. The method as claimed in claim 3; and cleaning the resonator.

5. The method as claimed in claim 4, said cleaning step including the step of chemically pickling the resonator.

6. The method as claimed in claim 1, said substrate comprising a superconducting material.

7. The method as claimed in claim 6, said substrate comprising niobium.

8. The method as claimed in claim 1, said monocrystalline region being generally cylindrical.

9. The method as claimed in claim 1, said markings being formed by a process selected from the group consisting of stamping and embossing.

10. The method as claimed in claim 1, said wafers being approximately 5 mm thick and having an extent in the plane of the cut area of 200 mm.

11. The method as claimed in claim 1, said area of the wafers being enlarged after cutting.

12. The method as claimed in claim 1, said forming step including the steps of pressing and deep-drawing.

13. The method as claimed in claim 12, said forming step including the step of creating a hollow truncated cone having two parallel open end areas.

14. The method as claimed in claim 12, said forming step including the step of rolling.

15. The method as claimed in claim 1, said forming step including the step of creating a hollow cone.

16. The method as claimed in claim 15, said hollow cone presenting a largest diameter that is greater than or equal to the external diameter of the half-cells.

17. The method as claimed in claim 1, said half-cells being rotationally symmetrical.

18. The method as claimed in claim 1, said joining step including the step of electron beam welding.

19. The method as claimed in claim 2, and cleaning the areas selected from the group consisting of the joining areas, the termination areas, and both the joining and termination areas, said cleaning step being accomplished prior to said joining step.

20. The method as claimed in claim 19, said cleaning step including the step of chemically pickling the areas.

21. The method as claimed in claim 1; and thermally treating the hollow body.

22. The method as claimed in claim 21, said thermally treating step including the steps of heating over a period of two to six hours at 400° C. to 500° C. and then heating over a period of one to three hours at 750° C. to 850° C.

23. The method as claimed in claim 21, said thermally treating step including the steps of heating over a period of two to six hours at 400° C. to 500° C. and then heating over a period of one to three hours at 750° C. to 800° C.

* * * * *